US009466185B2

(12) United States Patent
Lee et al.

(10) Patent No.: US 9,466,185 B2
(45) Date of Patent: Oct. 11, 2016

(54) MEDIUM HANDLING APPARATUS AND FINANCIAL DEVICE

(71) Applicant: LG CNS CO., LTD., Seoul (KR)

(72) Inventors: Chang Jin Lee, Seoul (KR); Sang Hoon Shin, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/265,812

(22) Filed: Apr. 30, 2014

(65) Prior Publication Data

US 2014/0318925 A1 Oct. 30, 2014

(30) Foreign Application Priority Data

Apr. 30, 2013 (KR) ..... 10-2013-0048062
Dec. 18, 2013 (KR) ..... 10-2013-0157724

(51) Int. Cl.
*G07F 7/04* (2006.01)
*G07F 19/00* (2006.01)
*G07D 11/00* (2006.01)

(52) U.S. Cl.
CPC ..... *G07F 19/202* (2013.01); *G07D 11/0018* (2013.01); *G07D 11/0021* (2013.01); *G07F 19/00* (2013.01); *G07F 19/203* (2013.01)

(58) Field of Classification Search
CPC ..... G07D 11/00; G07D 11/0018; G07D 11/0021; G07D 11/0024; G07D 2211/00; G07F 19/00; G07F 19/202; G07F 19/203
USPC ..... 194/206, 342, 343, 344, 351; 312/332, 312/334.1, 334.5, 348.5
See application file for complete search history.

(56) References Cited

U.S. PATENT DOCUMENTS

| | | | | |
|---|---|---|---|---|
| 7,497,339 | B2 * | 3/2009 | Nagura | 209/534 |
| 2012/0031728 | A1 | 2/2012 | Lee | |
| 2014/0239063 | A1 * | 8/2014 | Lewis et al. | 235/379 |
| 2015/0179014 | A1 * | 6/2015 | Nishino | G07D 7/0033 194/206 |

FOREIGN PATENT DOCUMENTS

| | | | |
|---|---|---|---|
| JP | 2007-72973 | A | 3/2007 |
| JP | 2011-059765 | A | 3/2011 |
| JP | 2012-074068 | A | 4/2012 |
| KR | 10-1094499 | B1 | 12/2011 |
| KR | 10-2012-0007701 | A | 1/2012 |

OTHER PUBLICATIONS

Office Action dated Apr. 29, 2014 in Korean Application No. 10-2013-0048062.
Notice of Allowance dated Jan. 30, 2015 in Korean Application No. 10-2013-0157724.

* cited by examiner

*Primary Examiner* — Mark Beauchaine
(74) *Attorney, Agent, or Firm* — Saliwanchik, Lloyd & Eisenschenk

(57) ABSTRACT

Provided is a medium handling apparatus. The medium handling apparatus comprises a guider to define a first space in which a medium to be deposited and a medium to be withdrawn are handled and a second space in which a rejected medium is handled and at least one pick-up roller to pick up the medium that is disposed in each of the first and second spaces.

21 Claims, 12 Drawing Sheets

MEDIUM HANDLING APPARATUS AND FINANCIAL DEVICE

CROSS-REFERENCE TO RELATED APPLICATIONS

This application claims the benefit under 35 U.S.C. §119 of Korean Patent Application Nos. 10-2013-0048062, filed Apr. 30, 2013, and 10-2013-0157724, filed Dec. 18, 2013, which are hereby incorporated by reference in their entirety.

BACKGROUND

The present disclosure relates to a medium handling apparatus and a financial device.

Generally, financial devices are devices that process a financial transaction that is desired by a customer. The financial devices deposit or withdraw a medium or automatically transfer the medium. The financial devices may comprise a medium handling apparatus for depositing or withdrawing a medium and a storage box for storing a medium.

The medium handling apparatus may move a medium by using a plurality of guiders. A first space in which a medium for a first operation is disposed and a second space in which a medium for a second operation is disposed are defined by the plurality of guiders. However, according to the financial device according to the related art, since the medium disposed in the first space is picked up and then stored, the medium disposed in the second space has to be moved into the first space to store the medium in the storage box. Thus, the plurality of guiders may be complicated in structure, and also a method for controlling the plurality of guiders may be complicated.

BRIEF SUMMARY

Embodiments provide a medium handling apparatus and a financial device.

In one embodiment, a medium handling apparatus comprises: a guider to define a first space in which a medium to be deposited and a medium to be withdrawn are handled and a second space in which a rejected medium is handled; and at least one pick-up roller to pick up the medium that is disposed in each of the first and second spaces.

In another embodiment, a financial device comprises: a customer information acquisition part to acquire customer's information; and a medium handling apparatus having a plurality of divided spaces, wherein the plurality of divided spaces comprises a space in which media to be deposited and withdrawn are respectively accepted and dispensed and a space in which the rejected medium is dispensed, and the medium is picked up from each of the spaces.

In further another embodiment, a financial device comprises: a customer information acquisition part to acquire customer's information; a medium handling apparatus to deposit or withdraw a medium; and a mode change unit to change a mode of the medium handling apparatus, wherein the medium handling apparatus comprises a front guider, a first pressing part disposed at a rear side of the front guider, a second pressing part disposed at a rear side of the first pressing part, and a rear guider disposed at a rear side of the second pressing part, and media to be deposited and withdrawn are respectively accepted and dispensed in a space between the front guider and the first pressing part or in a space between the second pressing part and the rear guider according to the mode of the medium handling apparatus.

The details of one or more embodiments are set forth in the accompanying drawings and the description below. Other features will be apparent from the description and drawings, and from the claims.

DETAILED DESCRIPTION

Figure 1:
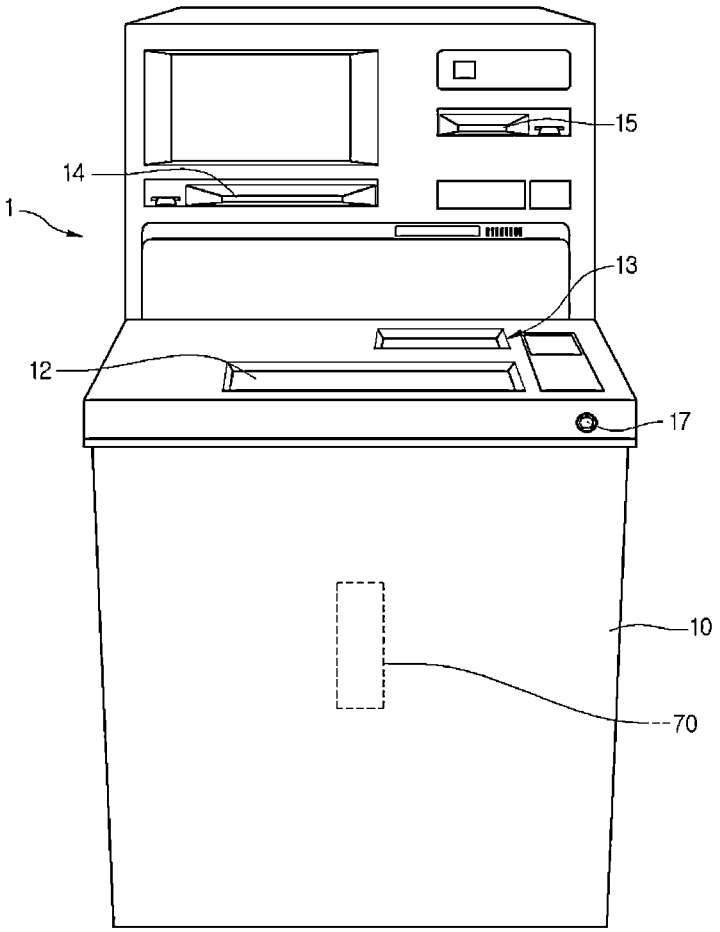
FIG. 1 is a perspective view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

In this specification, deposit represents transaction for depositing money in a bank account, and withdrawal represents transaction for withdrawing money from the bank account. Also, acceptance represents an operation for accepting a medium into a predetermined space, and dispensing represents an operation for dispensing the medium from the predetermined space.

Figure 2:
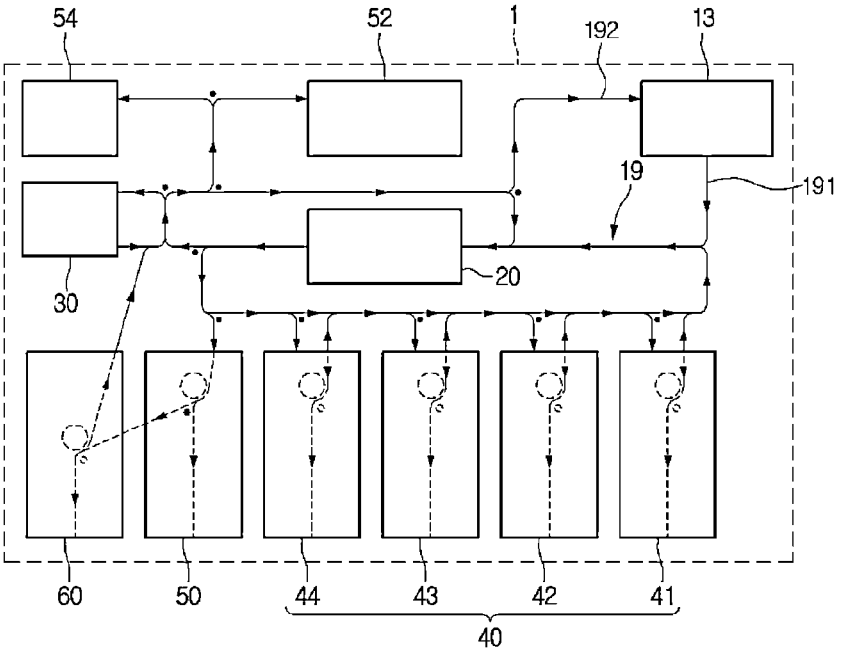
FIG. 2 is a block diagram of the financial device according to an embodiment.

FIG. 1 is a perspective view of a financial device according to an embodiment, and FIG. 2 is a block diagram of the financial device according to an embodiment.

Referring to FIGS. 1 and 2, a financial device 1 according to an embodiment comprises a main body 10 in which a plurality of components are built. The main body 10 comprises a medium accepting and dispensing unit 13 for accepting or dispensing a medium and at least one medium storage box 18 for storing the medium. The at least one medium storage box 40 may be separably mounted on the main body 10.

The medium accepting and dispensing unit 13 may comprise a medium handling space that is accessible by a customer. The medium handling space may be opened or closed by a blocking member such as a shutter or cover. In some cases, the medium handling space may not be opened or closed, but be maintained in an opened state.

The medium accepting and dispensing unit 13 may serve as a common accepting and dispensing unit through which various kinds of media are acceptable or dispensable. The media may be accepted into the medium accepting and dispensing unit 13 in unit of bundle comprising a sheet of medium. Also, the media in unit of bundle may be dispensed from the medium accepting and dispensing unit 13.

Also, the medium accepting and dispensing unit 13 may further comprise a medium handling apparatus (see reference numeral 100 of FIG. 4) for handling the medium accepted or dispensed into the medium handling space. The medium handling apparatus will be described later.

Also, according to a kind of financial device 1, the financial device 1 may further comprise a bankbook entrance part 14 for accepting or dispensing a bankbook and a card entrance part 15 for accepting or dispensing a card. In the current embodiment, the bankbook entrance part 14 or the card entrance part 15 may be called a customer information acquisition part to acquire customer's information. The current embodiment is not limited to a kind of customer information acquisition part. For example, the customer information acquisition part may acquire information recorded in an RFID tag or USB or acquire customer's information by using customer's fingerprint.

Also, the financial device 1 may further comprise a user interface 12 for displaying a menu and information for depositing or withdrawing a medium and for inputting or selecting a command or information for depositing or withdrawing the medium.

The financial device 1 may further comprise a discrimination part 20. The discrimination part 20 may distinguish a kind of medium or determine a faulty medium when the medium is accepted or dispensed.

The financial device 1 may further comprise a temporary stacker 30 in which the medium is temporarily stacked. The temporary stacker 30 may temporarily stack a medium accepted through the medium accepting and dispensing unit 13 when the customer intends to deposit the medium into the financial device 1. The medium stacked in the temporary stacker may be transferred into the medium storage box 40 when medium acceptance is finally determined by the customer.

The financial device 1 may further comprise a medium storage box 40 for storing a medium. The medium storage box 40 may comprise at least one banknote storage box 41, 42, and 43 and at least one check storage box 44. This specification is not limited to the number of banknote storage box 41, 42, and 43 and check storage box 44. Thus, only the banknote storage box may be provided in the financial device 1. Alternatively, only the check storage box may be provided in the financial device 1.

The medium storage box 40 may have a medium inlet for accepting the transferred medium and a medium outlet for dispensing internally stacked medium to the outside. In general, the medium inlet and the medium outlet may be disposed in an upper end of the box that defines an outer appearance of the medium storage box 40.

Also, a medium stacking unit for stacking media transferred from the outside of the medium storage box 40 in parallel to each other and a medium pick-up unit for separating the stacked media one by one to transmit the separated medium to the outside of the medium storage box 40 may be disposed in the medium storage box 40. That is, the medium stored in the medium storage box 40 may be dispensed to the outside, and the deposited medium may be stored in the medium storage box 40.

The financial device 1 may further comprise a first collection box 50 for collecting a medium that is determined as faulty in the deposit process and a second collection box 52 for collecting a medium that is determined as faulty in the withdrawal process, and a collection and supplement box 60.

The collection and supplement box 60 may supplement a medium into the medium storage box 40 or collect a medium from the medium storage box 40. Also, the financial device 1 may further comprise a third collection box 54 for collecting a non-taken medium when the customer does not take the medium that is dispensed from the medium accepting and dispensing unit 13 so as to be withdrawn.

In this specification, at least one of the plurality of collection boxes may be omitted.

In the current embodiment, respective modules (the medium accepting and dispensing unit, the discrimination part, the medium storage box, the temporary stacker, and the collection box) constituting the financial device 1 may be connected to each other by a transfer path 19.

The transfer path 19 may comprise a first path 191 and second path 192, which are connected to the medium accepting and dispensing unit 13.

The financial device 1 may further comprise a sensor 17 for detecting the customer, for example, a customer riding on a wheelchair. A photo sensor or an ultrasonic sensor may be used as the sensor 17. The current embodiment is not limited to a kind of sensor 17.

The financial device 1 may further comprise a controller 70. The controller 70 may determine a medium handling mode of the medium handling apparatus (see reference numeral 100 of FIG. 4) by using information that is detected by the sensor 17.

Figure 3:
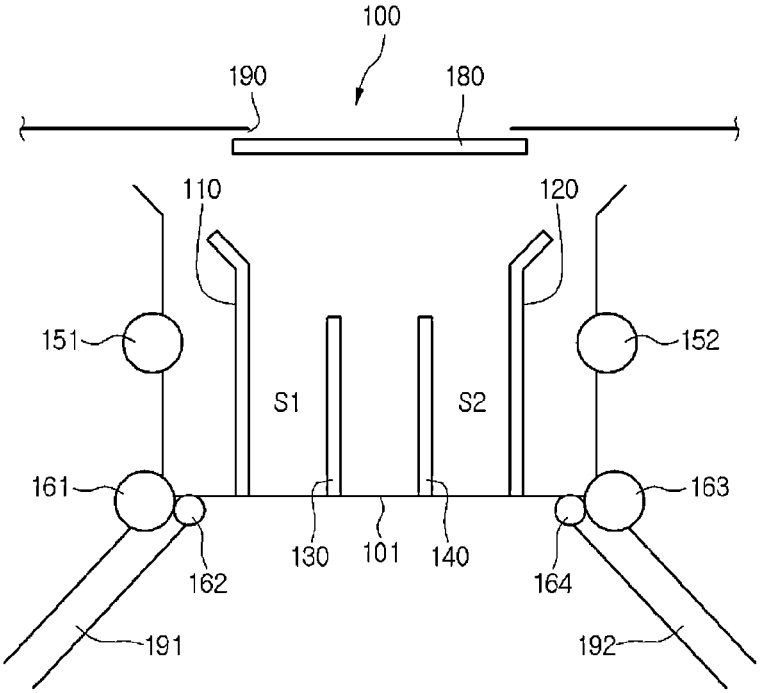
FIG. 3 is a schematic view of a medium handling apparatus according to an embodiment.
Figure 4:
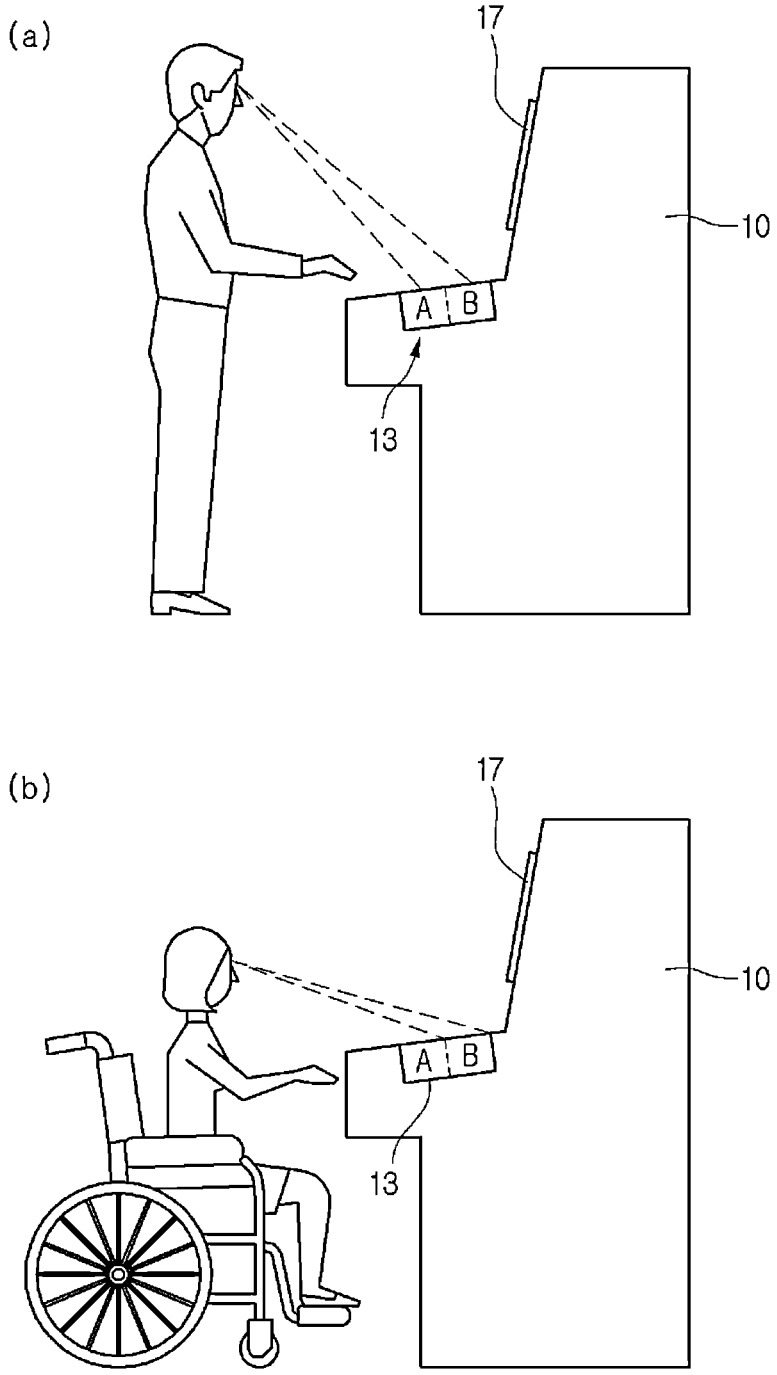
FIGS. 4A and 4B is a view illustrating a viewing angle of a customer that looks at a medium accepting and dispensing unit.

FIG. 3 is a schematic view of a medium handling apparatus according to an embodiment, and FIG. 4 is a view illustrating a viewing angle of a customer that looks at a medium accepting and dispensing unit.

A medium handling apparatus comprising a shutter may be described as an example in FIG. 3.

Referring to FIG. 3, a medium handling apparatus 100 according to an embodiment may comprise a front guider 110 (also, referred to as a "first guider"), a rear guide 120 (also, referred to as a "second guider"), and first and second pressing parts 130 and 140, which are disposed between the front guider 110 and the rear guider 120. In the current embodiment, the front guider 110, the first pressing part 130, the second pressing part 140, and the rear guider 120 may be successively disposed.

Also, the medium handling apparatus 100 may comprise a shutter 180 for opening or closing an opening 190 through which a medium is accepted or dispensed.

Each of the guiders 110 and 120 and each of the pressing parts 130 and 140 dependently move by a moving unit. In the current embodiment, the moving unit may, for example, comprise a motor. A power of the motor may be transmitted into an object to be moved (the guiders and the pressing parts) through a power transmission part, e.g., a belt. The current embodiment is not limited to a structure of the moving unit. Also, each of the guiders 110 and 120 and the pressing parts 130 and 140 may not interfere with other components when being moved.

In this specification, a space defined between the font guider 110 and the first pressing part 130 may be defined as a first space S1, and a space defined between the second pressing part 140 and the rear guider 120 may be defined as a second space S2.

That is, the medium handling space may comprise the first space S1 and the second space S2. Here, the first and second spaces S1 and S2 may be variable spaces, but are not fixed spaces. Each of the first and second spaces S1 and S2 may be changed in position and size according to movement of each of the guiders 130 and 140 and each of the pressing parts 130 and 140. Also, a medium in each of the spaces S1 and S2 may be supported by a support surface 101.

Referring to FIG. 4A, when the medium accepting and dispensing unit is divided into a front region A (that corresponds to a left portion of the medium handling apparatus in FIG. 3) and a rear region B (that corresponds to a right portion of the medium handling apparatus in FIG. 3) with respect to forward and backward directions of the financial device 1, the front region A and the rear region B may be disposed within a viewing angle of regular adults. Alternatively, the front region A having a relatively large area and the rear region B having a relatively small area may be disposed within a viewing angle of the customer according to a height of the customer.

On the other hand, referring to FIG. 4B, in a case of the customer riding on the wheelchair, the front region A may be rarely disposed within the viewing angle of the customer, and the rear region B may be mostly disposed.

Thus, if the medium is accepted or dispensed in only the front region A, in case of the customer riding on the wheelchair, it may be difficult to confirm the medium accepted or dispensed in the medium handling space through naked eyes thereof. As a result, the medium dispensed in the medium handling space may not be taken.

Thus, in the current embodiment, the medium handling apparatus may operate in two medium handling modes. Also, a relative position of the space for depositing and withdrawing may be variable according to the medium handling modes.

That is, in the current embodiment, the medium handling mode may comprise a first mode and a second mode. In the first mode, a medium to be deposited may be accepted in the first space S1, and a medium to be withdrawn may be dispensed in the first space S1. Also, a rejected medium may be dispensed in the second space S2.

On the other hand, in the second mode, a medium to be deposited may be accepted in the second space S2, and a medium to be withdrawn may be dispensed in the second space S2. Also, a rejected medium may be dispensed in the first space S1.

The controller 70 may control the medium handling apparatus 10 to fundamentally operate in the first mode. When the customer riding on the wheelchair is detected by the sensor 17, the controller 70 may control the medium handling apparatus 100 to operate in the second mode. Also, when the transactions such as the deposit or withdrawal of the medium is completed in the second mode, the controller 70 may control the medium handling apparatus 100 to operate again in the first mode.

For another example, a mode select button for selecting a mode may be disposed in the financial device 1. Here, the medium handling apparatus may vary in mode according to the selected mode. Alternatively, the mode select button may be disposed on the user interface 12, and the medium handling apparatus may vary in mode according to the selection of the mode select button.

That is, in this specification, the sensor 17, the user interface 12, or the mode select button that is a component different from the user interface 12 may be called a mode change unit.

Here, when the mode change unit comprises the user interface 12, the user interface 12 may display a menu and information for depositing or withdrawing and input or select a command or information for depositing or withdrawing.

In the current embodiment, the first and second spaces S1 and S2 may vary in position in forward and backward directions. However, an absolute position of the first space S1 in the first mode may be disposed at a front side of an absolute position of the second space S2. Here, in this specification, the "front side" may represent a side that is close to a front surface of the financial device.

As described above, since the first space S1 is disposed at a front side of the second space S2, if a medium to be deposited in the first space S1 is accepted, or a medium to be withdrawn is dispensed in the first space S1, the customer riding on the wheelchair may have poor visibility with respect to the medium disposed in the first space S1.

Particularly, if a few media are disposed in the first space S1, the visibility may be significantly reduced. In this case, the customer may not take medium disposed in the first space S1. Thus, in the current embodiment, to improve the visibility of the customer, the medium to be deposited may be accepted in the second space S2, and the medium to be withdrawn may be dispensed in the second space S2 in the second mode.

The medium handling apparatus 100 may comprise a first pick-up roller 151 for picking up the medium of the first space S1, a first feed roller 161, and a first gate roller 162.

The first feed roller 161 may transfer the medium picked up in the first space S1 to the first path 191. Also, the first feed roller 161 and the first gate roller 162 may transfer the medium of the first path 191 into the first space S1.

The medium handling apparatus 100 may comprise a second pick-up roller 152 for picking up the medium of the second space S2, a second feed roller 163, and a second gate roller 164.

The first feed roller 163 may transfer the medium picked up in the first space S1 to the first path 192. Also, the second feed roller 163 and the second gate roller 162 may transfer the medium of the second path 192 into the second space S2.

Also, the first pick-up roller 151 and the first feed roller 161 may independently operate by a driving part. Alternatively, the first pick-up roller 151 may operate by a driving power of the driving part for driving the first feed roller 161.

Also, the second pick-up roller 152 and the second feed roller 163 may independently operate by a driving part. Alternatively, the second pick-up roller 152 may operate by a driving power of the driving part for driving the second feed roller 163.

Hereinafter, processes of depositing, withdrawing, and returning a medium in each mode will be described.

In this specification, the "reject" may represent to dispense a medium, which is picked up from one space of the first and second spaces S1 and S2 and then separated, into the other space, and the "return" may represent a process in which a rejected medium is in a state that is acceptable by the customer.

First, a medium handling process in the first mode will be described below.

Figure 5:
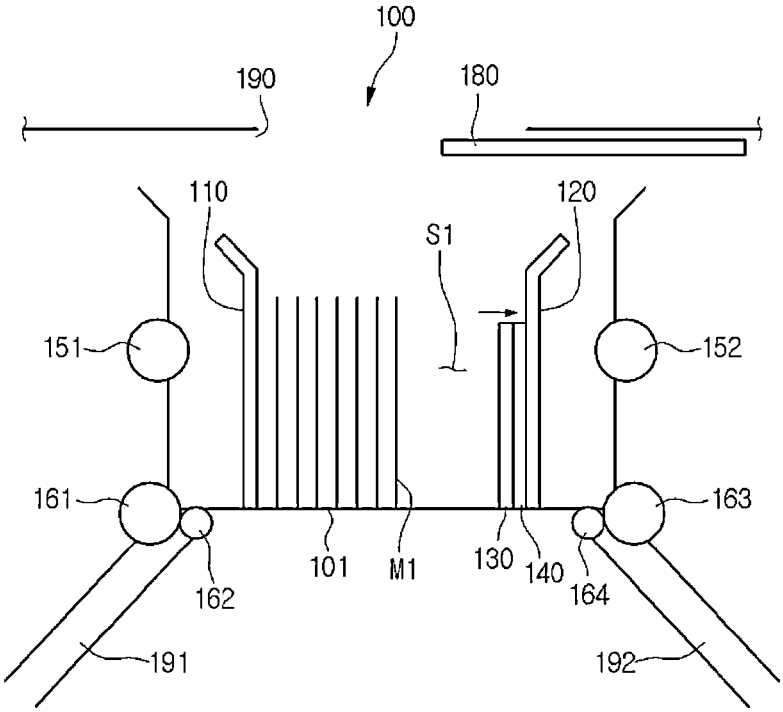
FIGS. 5 and 6 are views illustrating a process of depositing a medium in a first mode in the medium handling apparatus.
Figure 6:
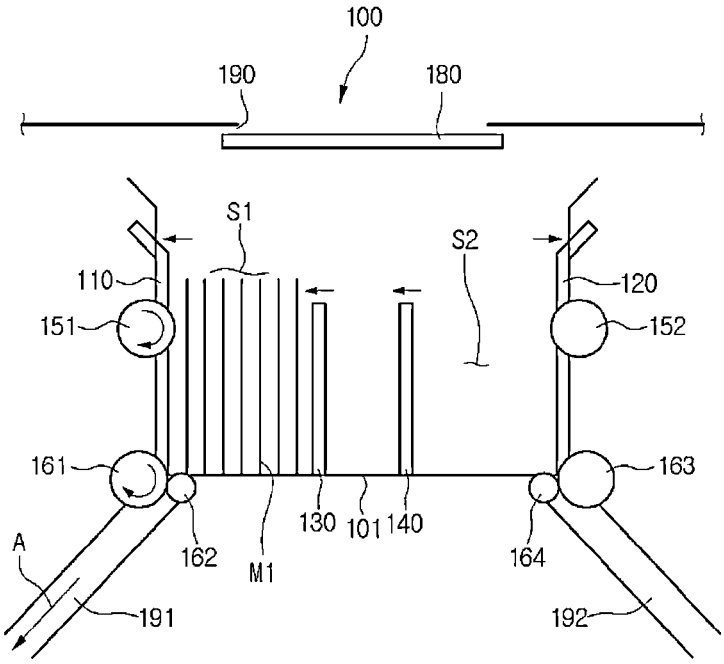
Figure 7:
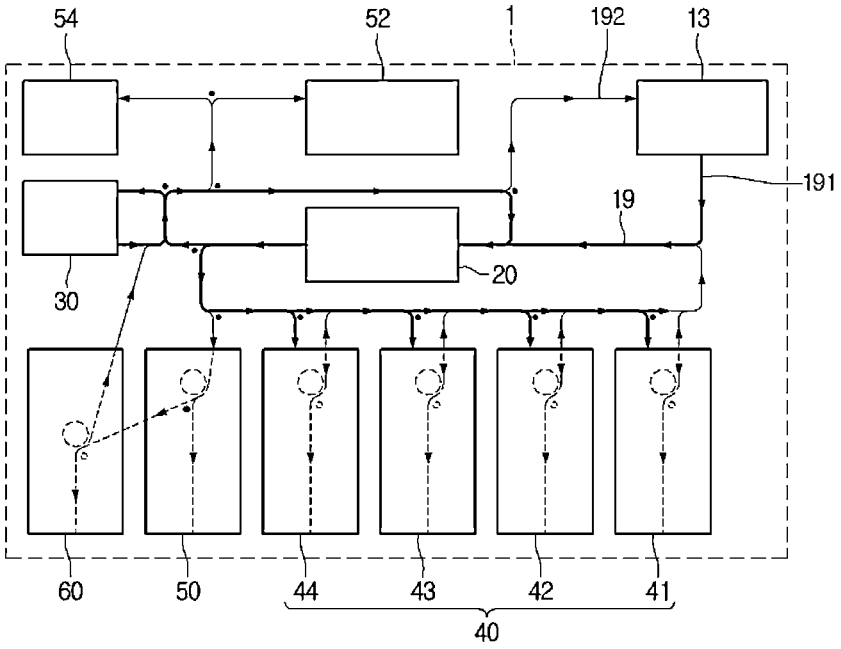
FIG. 7 is a view of a path through which a medium deposited in the first mode is transferred into the financial device.

FIGS. 5 and 6 are views illustrating a process of depositing a medium in the first mode in the medium handling apparatus, and FIG. 7 is a view of a path through which a medium deposited in the first mode is transferred into the financial device.

Referring to FIG. 5, to accept a medium M1 to be deposited, each of the guiders 110 and 120 and each of the pressing parts 130 and 140 may be in a deposit standby state. That is, the front guider 110 and the rear guider 120 move to positions at which the front guider 110 and the rear guider 120 are maintained at a certain distance. Then, the first and second pressing parts 130 and 140 move toward the rear guider 120. For example, the second pressing part 140 may contact the rear guider 120, and the first pressing part 130 may contact the second pressing part 140. In FIG. 5, positions of the front and rear guiders may be called deposit reference positions for depositing a medium in the first mode. Also, in FIG. 5, positions of the first and second pressing parts may be called deposit reference positions in the first mode.

When becomes to the deposit standby state, the shutter 180 may be opened. Thus, a medium may be accepted in the first space S1 between the front guider 110 and the first pressing part 130. Here, the shutter 180 may fully open the opening 190 or partially open the opening 190. For example, the shutter 180 may open a front side of the opening 190 corresponding to the first space S1 and may not open a rear side of the opening 190 corresponding to the second space S2. Also, when the medium is completely accepted in the first space S1, the shutter 180 is closed.

Then, referring to FIG. 5, the front guider 110 and the first pressing part 130 may move to the first pick-up roller 151 and be placed at a pick-up standby position to pick the medium M1 of the first space S1 up. For example, the front guider 110 and the first pressing part 130 move to a left side in FIG. 6. Thus, the first space S1 may move to the left side, and the first pressing part 130 may press the medium M1 toward the first pick-up roller 151. Also, the rear guider 120 may move toward the second pick-up roller 162 and be placed at a staking standby position. Also, the second pressing part 140 and the rear guider 120 may move to positions that are spaced a predetermined distance from each other. Here, the second pressing part 140 may move to the left side or a right side or be maintained in a stopped state in FIG. 5 so that the second pressing part 140 is maintained at a predetermined distance from the rear guider 120. In the current embodiment, the movement of the rear guide 120 to the standby position and the movement of the second pressing part 140 to the position at which the second pressing part 140 is spaced a predetermined distance from the rear guider 120 may be for securing the second space S2 having a predetermined size.

Then, the first pick-up roller 151 may rotate, and the medium M1 to be deposited may be picked up one by one to move downward. The picked medium M1 may move along the first path 191 by the rotation of the first feed roller 161 and then be transferred one by one (see arrow A).

Referring to FIG. 7, the medium in the first path 191 may pass through the discrimination part 20 and then be stacked in the temporary stacker 30. Also, the user interface 12 may display information for receiving a deposit cancel or confirmation command, and the user may input the confirmation command or deposit cancel command. When the deposit confirmation command is inputted, the medium stacked in the temporary stacker 30 may pass through the discrimination part 20 again to move to the medium storage box 40, thereby being stored in the medium storage box 40.

Figure 8:
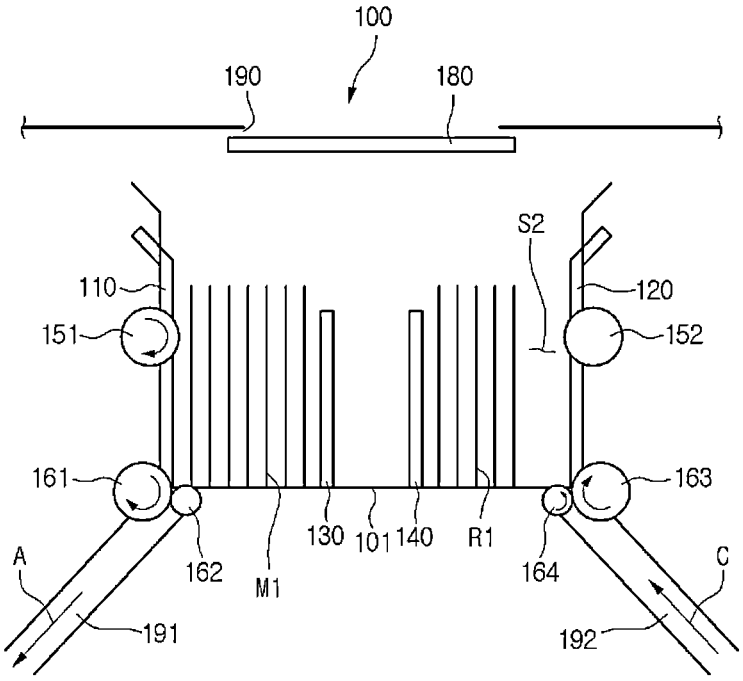
FIG. 8 is a view illustrating a process of depositing accepted media and a process of rejecting a portion of the media in the first mode.
Figure 9:
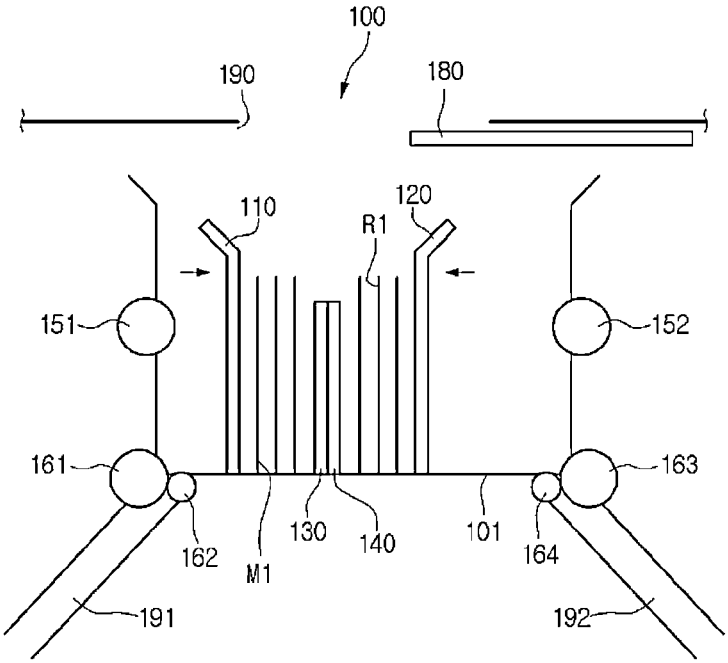
FIG. 9 is a view illustrating a process of returning the rejected medium together with the accepted media due to cancelled deals in the first mode.
Figure 10:
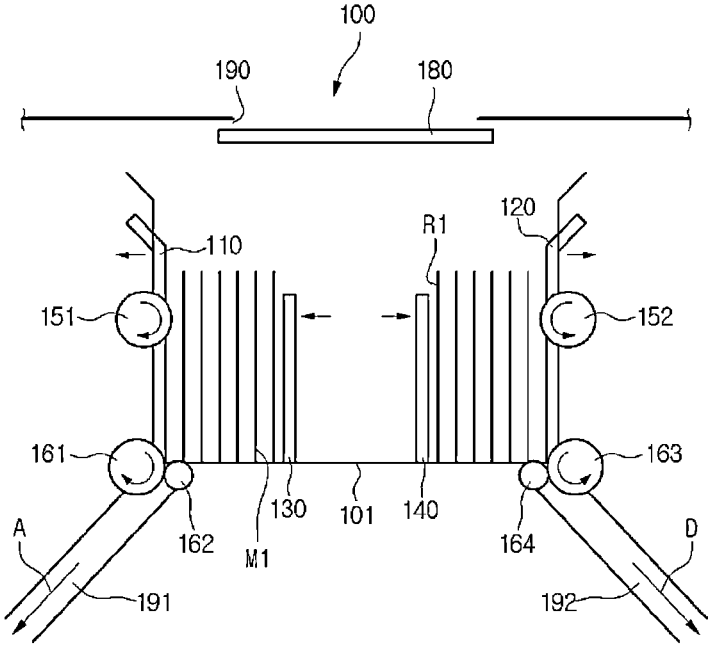
FIG. 10 is a view illustrating a process of re-depositing a medium that is not taken in the first mode.
Figure 11:
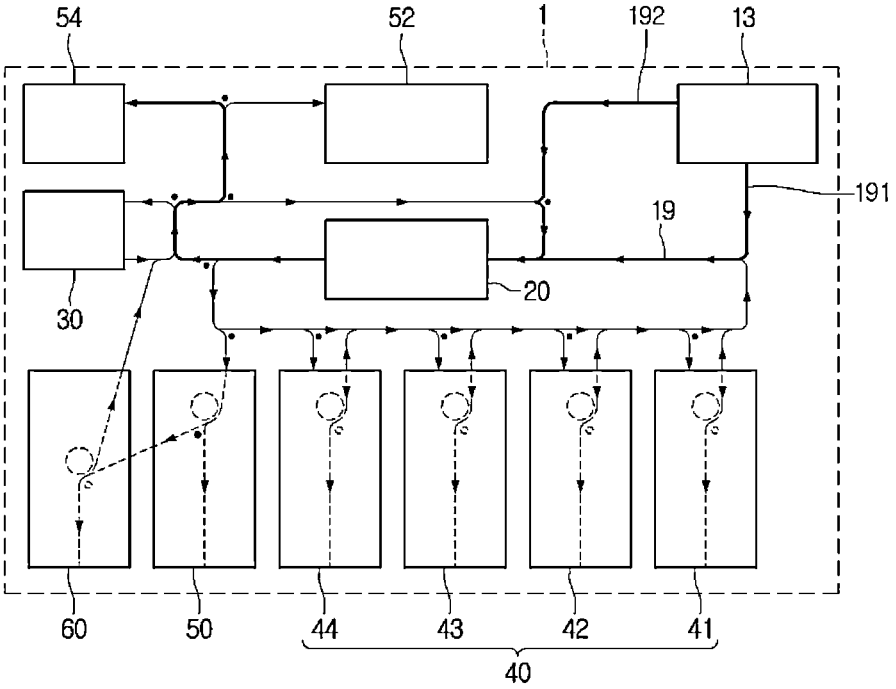
FIG. 11 is a view illustrating a path through which the medium that is not accepted in the first mode is re-deposited within the financial device.

FIG. 8 is a view illustrating a process of depositing accepted media and a process of rejecting a portion of the media in the first mode, FIG. 9 is a view illustrating a process of returning the rejected medium together with the accepted media due to cancelled deals in the first mode, FIG. 10 is a view illustrating a process of re-depositing a medium that is not accepted in the first mode, and FIG. 11 is a view illustrating a path through which the medium that is not taken in the first mode is re-deposited within the financial device.

Referring to FIG. 8, when it is determined that a medium recognition error occurs, or the medium is damaged according to discrimination results of the medium accepted into the first space S1, a medium R1 passing through the discrimination part 20 is rejected into the second space S2 through the second path 192 (see arrow C). Alternatively, in the stat where the medium is temporarily stacked in the temporary stacker 30, when the deposit cancel command is inputted, the medium may be rejected into the second space S2.

Then, referring to FIG. 9, to return the rejected medium, each of the guiders 110 and 120 and each of the pressing parts 130 and 140 may be in a return standby state. That is, each of the front guider 110 and the rear guider 120 may move from the pick-up standby position to the return reference position. The guiders 110 and 120 may move in directions which are close to each other in FIG. 9, respectively.

Also, each of the pressing parts 130 and 140 may move to the return standby position. In FIG. 9, each of the pressing parts 130 and 140 may move in directions which are close to each other, respectively. Here, the pressing parts 130 and 140 may contact each other.

In the current embodiment, the deposit reference position of each of the guiders 110 and 120 may be equal to or different from the return reference position.

When each of the guiders 110 and 120 and each of the pressing parts 130 and 140 are in the return standby state, the shutter 180 may be opened, and the customer may take the returned medium out. Although the non-separated medium M1 that is not picked up by the first pick-up roller 151 in the first space S1 and the rejected medium R1 are divided by the pressing parts 130 and 140 in the return standby state, since the pressing parts 130 and 140 contact each other, the customer may take the non-separated medium M1 and the rejected medium R1 together with each other.

When the customer does not take the returned medium or inputs re-deposit command, the returned medium may be deposited again.

Referring to FIG. 10, to deposit the returned medium again, the front guider 110 and the first pressing part 130 may move to the first pick-up roller 151 and then be placed at the pick-up standby position. Also, the rear guider 120 and the second pressing part 140 may move to the second pick-up roller 162 and then be placed at the pick-up standby position.

That is, the guiders 110 and 120 may move in directions that are away from each other, as well as the pressing parts 130 and 140 may move in directions that are away from each other.

Then, the medium M1 of the first space S1 may be picked up by the first pick-up roller 151, ad the medium R1 of the second space S2 may be picked up by the second pick-up roller 152. The medium M1 picked up by the first pick-up roller 151 may be transferred to the first path 191 by the first feed roller 161, and the medium R1 picked up by the second pick-up roller 152 may be transferred to the second path 192 by the second feed roller 163 (see arrow D). Here, after the medium of one space of the first and second spaces S1 and S2 is completely picked up, the medium of the other space may be picked up.

The medium transferred along each of the paths 191 and 192 may pass through the discrimination part 20 and then be transferred to and stored in the third collection box 54.

Figure 12:
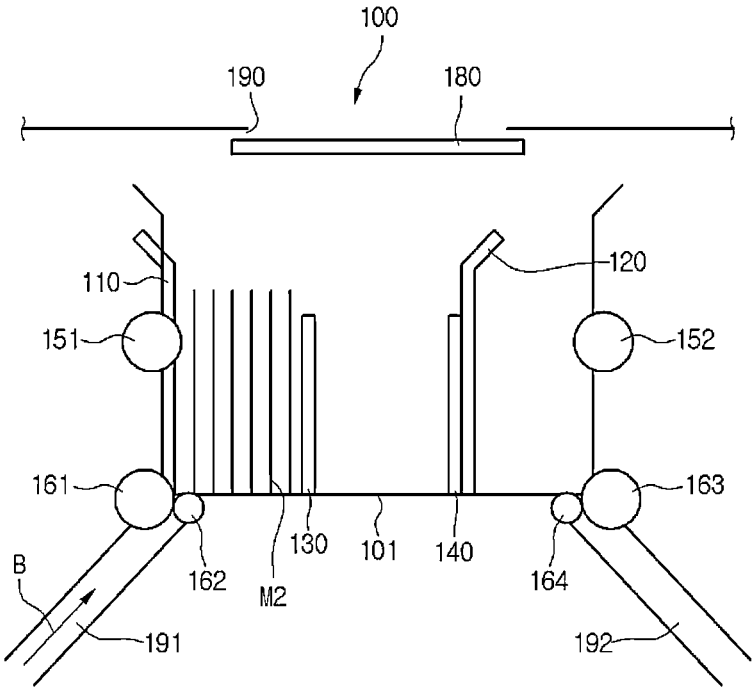
FIGS. 12 and 13 are view illustrating a process of withdrawing a medium in the first mode.
Figure 13:
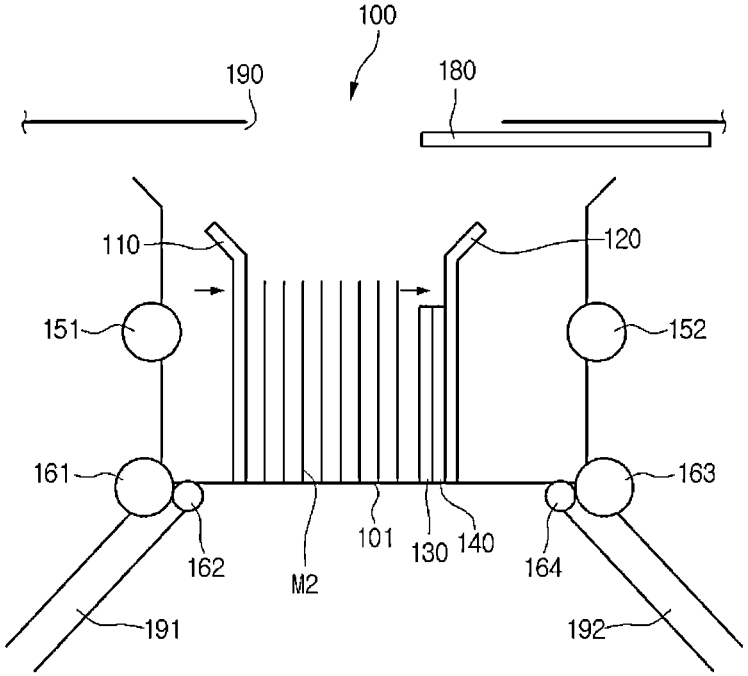
Figure 14:
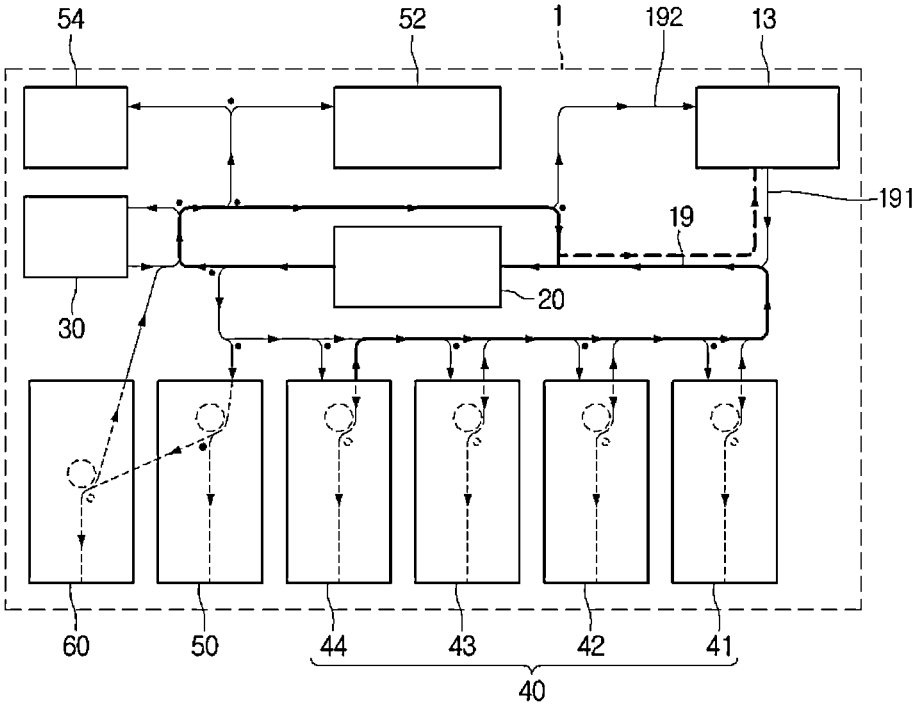
FIG. 14 is a view illustrating a path in which a medium is withdrawn in the first mode in the financial device.

FIGS. 12 and 13 are view illustrating a process of withdrawing a medium in the first mode, and FIG. 14 is a view illustrating a path in which a medium is withdrawn in the first mode in the financial device.

Referring to FIG. 12, to withdraw the medium, the front guider 110 may move to the staking standby position (that is equal to or different from the pick-up standby position of the front guider 110 in FIG. 6), and the first pressing part 130 may move to a position that is spaced a predetermined distance from the front guider 110. This is done for securing the first space S1 for accepting the medium to be withdrawn.

Also, each of the second pressing part 140 and the rear guider 120 may move to the deposit reference position. Here, the second pressing part 140 may be maintained in contact with the rear guider 120.

Then, the medium M2 stored in the medium storage box 40 may be dispensed from the medium storage box 40 to pass through the discrimination part 20. Then, the medium M2 may be transferred into the first space S1 through the first path 191 and then stacked into the first space S1. When the transferring of the medium M2 is completed, each of the first pressing part 130 and the front guider 110 may move to the withdrawal reference position. Referring to FIG. 13, the front guider 110 and the first pressing part 130 may move to the rear guider 140.

In the current embodiment, the state in which each of the guider and pressing part is disposed at the withdrawal reference position may be called a "deposit standby state". The shutter may be opened in the withdrawal standby state to allow the customer to take the medium out.

If the customer does not take the dispensed medium, the non-taken medium may be re-deposited through the processes described in FIG. 6.

According to the current embodiment, since the deposit, withdrawal, return, and re-deposit of the medium are performed by only the movement of each of the guider and pressing part in the forward or backward direction in the state where the guider and pressing part are maintained in position, a medium handling time may be reduced.

Also, since the medium of the first space S1 is picked up by the first pick-up roller 151, and the medium of the second space S2 is picked up by the second pick-up roller 152, the customer may re-deposit the medium without taking the medium and then re-acceptance the medium so as to re-deposit the medium to be withdrawn or the rejected medium.

Also, to re-deposit the rejected medium, it may be unnecessary that the rejected medium moves from the first space to the first space. Thus, the medium handling time may be reduced.

In the current embodiment, the deposit reference position of each of the guiders and pressing parts may be equal to or different from the withdrawal reference position.

Next, a medium handling process in the second mode will be described below.

Figure 15:
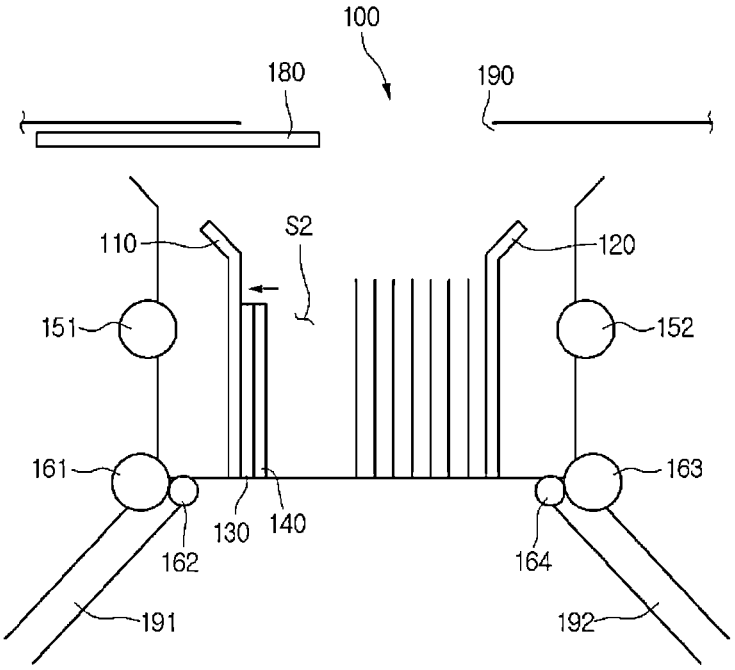
FIGS. 15 and 16 are views illustrating a process of depositing a medium in a second mode in the medium handling apparatus.
Figure 16:
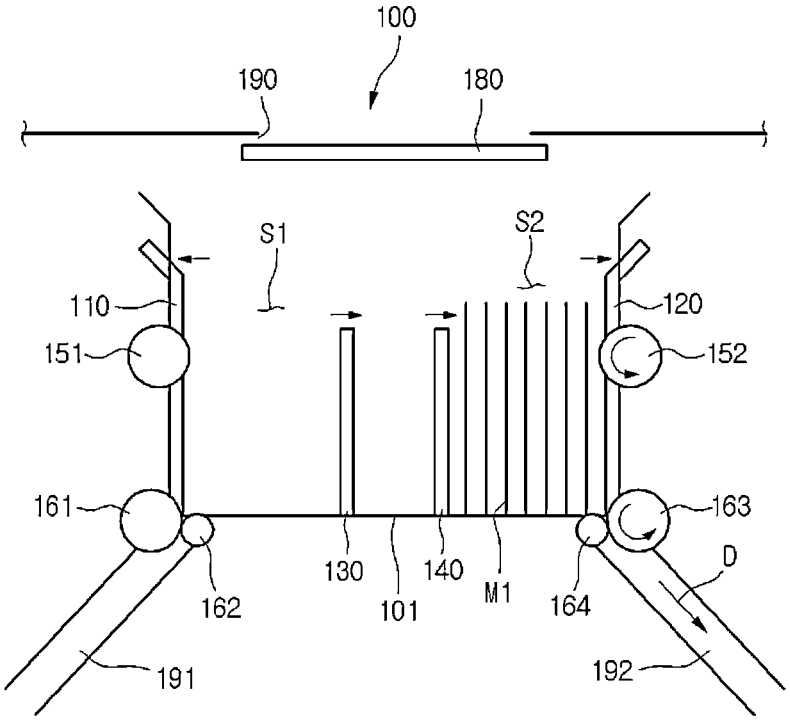

FIGS. 15 and 16 are views illustrating a process of depositing a medium in the second mode in the medium handling apparatus.

Referring to FIG. 15, the controller 70 may control the medium handling apparatus 100 to operate the second mode when a selection command for the second mode is received, or the customer riding on the wheelchair is detected by the sensor 17.

To accept a medium M1 to be deposited, each of the guiders 110 and 120 and each of the pressing parts 130 and 140 may be in the deposit standby state. That is, the front guider 110 and the rear guider 120 move to positions at which the front guider 110 and the rear guider 110 are maintained at a certain distance. Then, the first and second pressing parts 130 and 140 move to the front guider 110. For example, the second pressing part 130 may contact the front guider 110, and the first pressing part 130 may contact the second pressing part 140. In FIG. 15, positions of the front and rear guiders may be called deposit reference positions for depositing a medium in the second mode. Also, in FIG. 15, positions of the first and second pressing parts may be called deposit reference positions in the second mode.

When becomes to the deposit standby state, the shutter 180 may be opened. Thus, a medium may be accepted into the second space S2 between the rear guider 120 and the second pressing part 140. Here, the shutter 180 may fully open the opening 190 or open a rear side of the opening 190 corresponding to the second space S2 and may not open a front side of the opening 190 corresponding to the first space S1. Also, when the medium is completely accepted into the second space S2, the shutter 180 is closed.

Then, referring to FIG. 16, the rear guider 120 and the second pressing part 140 may move to the second pick-up roller 152 and be placed at the pick-up standby position to pick the medium M1 of the second space S1 up. For example, the rear guider 120 and the second pressing part 140 move in a right side in FIG. 16. Thus, the second space S2 may move in the right side, and the second pressing part 140 may press the medium M1 toward the second pick-up roller 152.

Also, the front guider 110 may move to the first pick-up roller 151 and be placed at the staking standby position. Also, the first pressing part 130 and the front guider 110 may move to positions that are spaced a predetermined distance from each other. Here, the first pressing part 130 may move to the right side or be maintained in a stopped state in FIG. 15 so that the first pressing part 130 is maintained at a predetermined distance from the front guider 110. In the current embodiment, the movement of the front guide 110 to the staking standby position and the movement of the first pressing part 130 to the position at which the first pressing part 130 is spaced a predetermined distance from the front guider 110 may be for securing the first space S1 having a predetermined size.

Then, the second pick-up roller 152 may rotate, and the medium M1 to be deposited may be picked up one by one to move downward. The picked medium M1 may move along the second path 192 by the rotation of the second feed roller 163 and then be transferred one by one (see arrow B).

Figure 17:
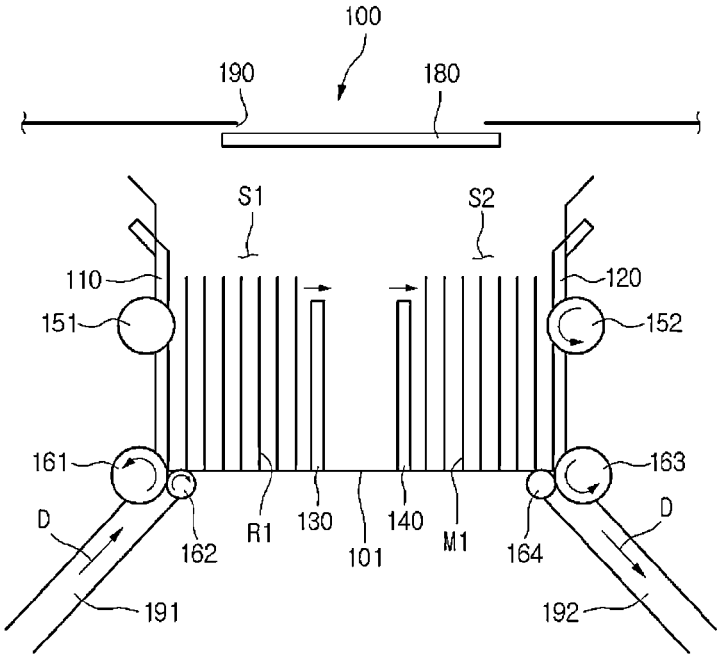
FIG. 17 is a view illustrating a process of depositing accepted media and a process of rejecting a portion of media in the second mode.
Figure 18:
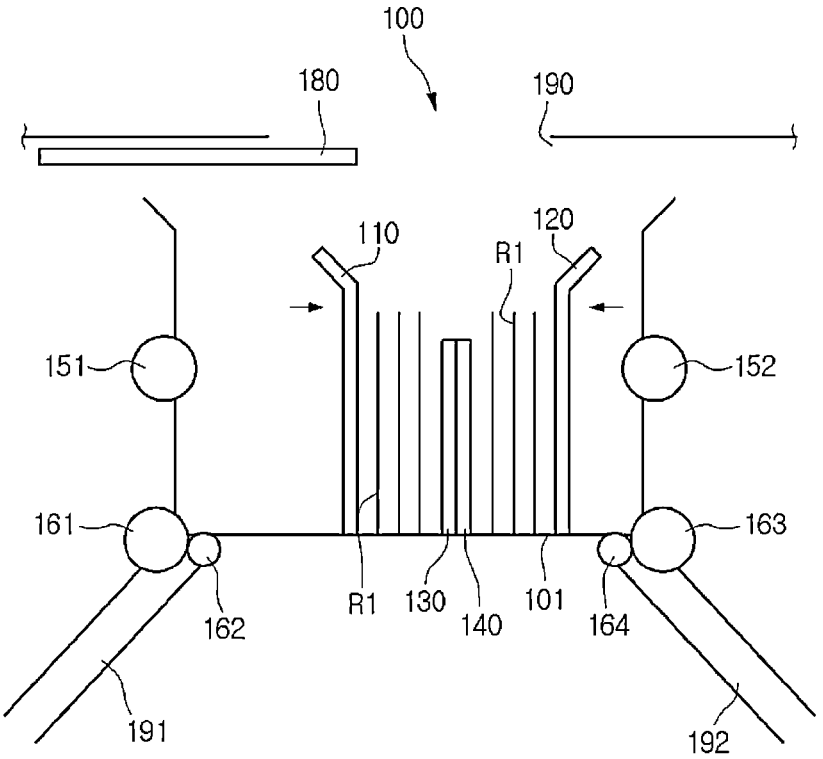
FIG. 18 is a view illustrating a process of returning the medium rejected in the second mode.
Figure 19:
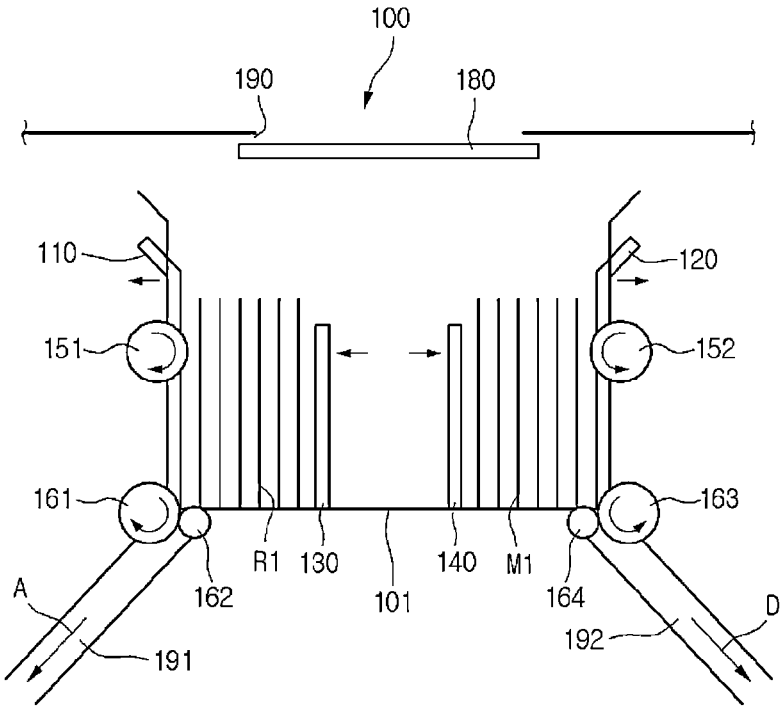
FIG. 19 is a view illustrating a process of re-depositing a medium that is not accepted in the second mode.

FIG. 17 is a view illustrating a process of depositing accepted media and a process of rejecting a portion of media in the second mode, FIG. 18 is a view illustrating a process of returning the medium rejected in the second mode, and FIG. 19 is a view illustrating a process of re-depositing a medium that is not taken in the second mode.

Referring to FIG. 17, when it is determined that a medium recognition error occurs, or the medium is damaged according to discrimination results of the accepted medium for depositing, a medium R1 passing through the discrimination part 20 is rejected into the first space S through the first path 191 (see arrow B). Alternatively, in the stat where the medium is temporarily stacked in the temporary stacker 30, when the deposit cancel command is inputted, the medium may be rejected into the first space S1.

Then, referring to FIG. 18, to return the rejected medium, each of the guiders 110 and 120 and each of the pressing parts 130 and 140 may be in the return standby state. That is, each of the front guider 110 and the rear guider 120 may move from the pick-up standby position to the return reference position. The guiders 110 and 120 may move in directions which are close to each other in FIG. 18, respectively.

Also, each of the pressing parts 130 and 140 may move to the return standby position. In FIG. 18, each of the pressing parts 130 and 140 may move in directions which are close to each other, respectively. Here, the pressing parts 130 and 140 may contact each other.

In the current embodiment, the deposit reference position of each of the guiders 110 and 120 may be equal to or different from the return reference position.

When each of the guiders 110 and 120 and each of the pressing parts 130 and 140 becomes to the return standby state, the shutter 180 may be opened, and the customer may take the returned medium out. Although the non-separated medium M1 that is not picked up by the second pick-up roller 152 in the second space S2 and the rejected medium R1 are divided by the pressing parts 130 and 140 in the return standby state, since the pressing parts 130 and 140 contact each other, the customer may take the non-separated medium M1 and the rejected medium R1 together with each other.

When the customer does not take the returned medium or inputs re-deposit command, the returned medium may be deposited again.

Referring to FIG. 19, to deposit the returned medium again, the front guider 110 and the first pressing part 130 may move to the first pick-up roller 151 and then be placed at the pick-up standby position. Also, the rear guider 120 and the second pressing part 140 may move to the second pick-up roller 162 and then be placed at the pick-up standby position.

That is, the guiders 110 and 120 may move in directions that are away from each other, as well as the pressing parts 130 and 140 may move in directions that are away from each other.

Then, the medium R1 of the first space S1 may be picked up by the first pick-up roller 151, and the medium M1 of the second space S2 may be picked up by the second pick-up roller 152. The medium R1 picked up by the first pick-up roller 151 may be transferred to the first path 191 by the first feed roller 161, and the medium M1 picked up by the second pick-up roller 152 may be transferred to the second path 192 by the second feed roller 163 (see arrow D). Here, after the medium of one space of the first and second spaces S1 and S2 is completely picked up, the medium of the other space may be picked up.

The medium transferred along each of the paths 191 and 192 may pass through the discrimination part 20 and then be transferred to and stored in the third collection box 54.

Figure 20:
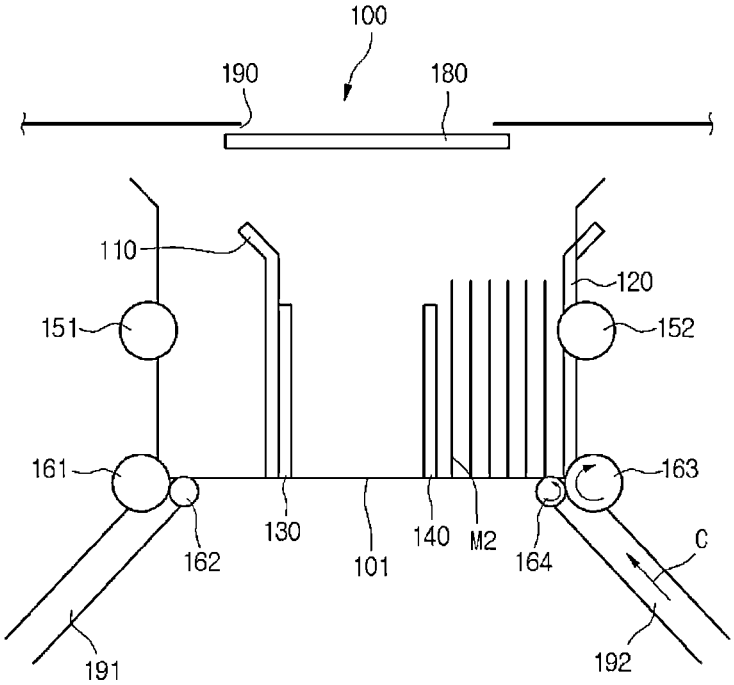
FIGS. 20 and 21 are views illustrating a process of withdrawing a medium in the second mode.
Figure 21:
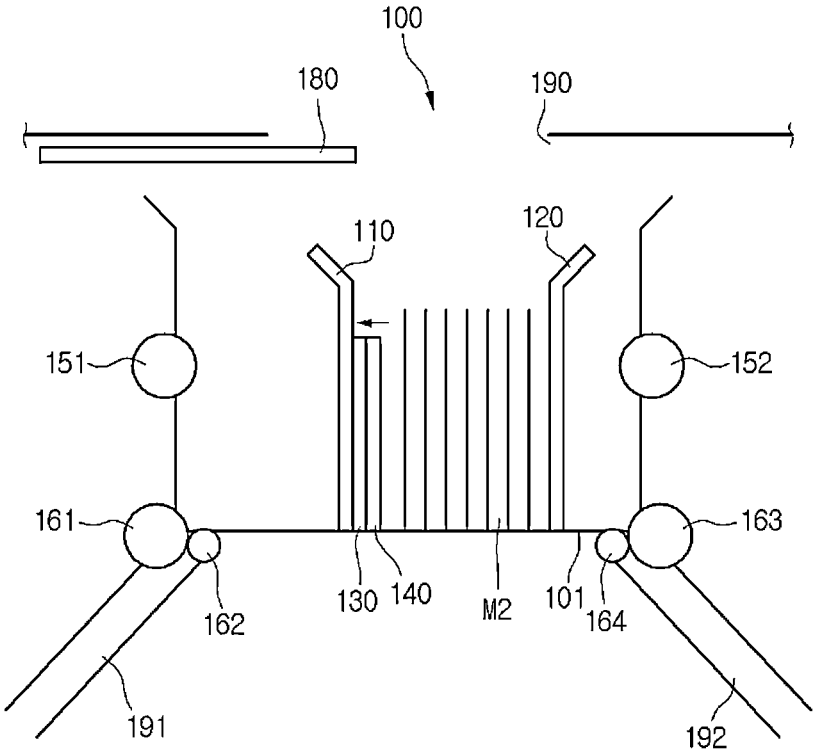

FIGS. 20 and 21 are views illustrating a process of withdrawing a medium in the second mode.

Referring to FIG. 20, to withdraw the medium, the rear guider 120 may move to the stacking standby position, and the second pressing part 140 may move to a position that is spaced a predetermined distance from the rear guider 110. This is done for securing the second space S2 for accepting the medium to be withdrawn.

Also, each of the first pressing part 130 and the front guider 110 may move to the deposit reference position. Here, the first pressing part 130 may be maintained in contact with the front guider 110.

Then, the medium M2 stored in the medium storage box 40 may be dispensed from the medium storage box 40 to pass through the discrimination part 20. Then, the medium M2 may be transferred into the first space S1 through the second path 192 and then stacked into the second space S1. When the transferring of the medium M2 is completed, each of the second pressing part 140 and the rear guider 120 may move to the withdrawal reference position. Referring to FIG. 21, the rear guider 110 and the second pressing part 140 may move to the front guider 110.

In the current embodiment, the state in which each of the guider and pressing part is disposed at the withdrawal reference position may be called a "deposit standby state". The shutter may be opened in the withdrawal standby state to allow the customer to take the medium out.

If the customer does not accept the dispensed medium, the non-taken medium may be re-deposited through the processes described in FIG. 19.

According to the current embodiment, since the space for depositing or withdrawing the medium varies in position according to the customer, the customer riding on the wheelchair as well as general customer may easily accept the medium or take the dispensed medium out. Thus, it may inhibit the medium from being not taken by the customer riding on the wheelchair.

In the foregoing embodiment, although the support surface for supporting the medium is horizontally disposed, the present disclosure is not limited thereto. For example, the support surface may be inclined with respect to the horizontal plane to improve the visibility for the medium. Here, the support surface may be inclined upward from the front guider toward the rear guider.

In the foregoing embodiment, although the medium handling apparatus operates in one mode of the two modes, the present disclosure is not limited thereto. For example, the medium handling apparatus may operate in only one mode according to the installation places of the financial device.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A medium handling apparatus comprising:

a guider defining a first space into which a medium to be deposited and from which a medium to be withdrawn are handled and a second space in which a rejected medium is handled;

a first pick-up roller to pick up the medium that is disposed in the first space;

a second pick-up roller to pick up the rejected medium that is disposed in the second space;

a first path through which the medium withdrawn from, deposited into, or picked up from the first space is transferred; and a second path through which the medium transferred into the second space or the rejected medium picked up from the second space is transferred.

2. The medium handling apparatus of claim 1, wherein the guider comprises:

a front guider;

a rear guider disposed spaced apart from the front guider;

a first pressing part disposed between the front guider and the rear guider; and a second pressing part disposed between the first pressing part and the rear guider.

3. The medium handling apparatus of claim 2, wherein the first pick-up roller picks up the medium disposed in the first space between the front guider and the first pressing part, and wherein the second pick-up roller picks up the medium disposed in the second space between the second pressing part and the rear guider.

4. The medium handling apparatus of claim 3, wherein, when the medium to be deposited in the first space is handled, at least one of the front guider and the first pressing part moves in a direction that is away from the other of the front guider and the first pressing part to deposit the medium.

5. The medium handling apparatus of claim 4, wherein, when the rejected medium is returned, the front guider and the rear guider move in directions that are close to each other.

6. The medium handling apparatus of claim 4, wherein, when a customer does not take the rejected medium in the second space, the second pressing part and the rear guider move to the second pick-up roller, and the second pick-up roller picks up the rejected medium.

7. The medium handling apparatus of claim 4, wherein, when the medium to be withdrawn is handled in the first space, at least one of the first and second pressing parts moves in a direction that is close to each other so that a customer takes the medium to be withdrawn in the first space out.

8. The medium handling apparatus of claim 3, wherein, when the medium to be deposited is handled in the second space, at least one of the rear guider and the second pressing part moves in a direction that is away from each other to deposit the medium.

9. The medium handling apparatus of claim 8, wherein, when the rejected medium is returned, the front and rear guiders move in directions that are close to each other.

10. The medium handling apparatus of claim 9, wherein, when a customer does not take the rejected medium in the first space out, the front guider and the first pressing part move toward the first pick-up roller, and the first pick-up roller picks up the rejected medium.

11. The medium handling apparatus of claim 8, wherein, when the medium to be withdrawn is handled in the second space, at least one of the first and second pressing parts moves in a direction that is close to each other so that a customer takes the medium to be withdrawn in the second space out.

12. The medium handling apparatus of claim 11, wherein, when the customer does not take the medium to be withdrawn in the second space out, the second pressing part and the rear guider move toward the second pick-up roller, and the second pick-up roller picks up the non-taken medium.

13. The medium handling apparatus of claim 1, wherein the medium withdrawn from the first space is transferred through the first path in a first direction, and the medium deposited into or picked up from the first space is transferred through the first path in a second direction opposite to the first direction.

14. A financial device comprising:

a customer information acquisition part to acquire customer's information; and a medium handling apparatus having a plurality of divided spaces and first and second paths, wherein the plurality of divided spaces comprises a first space into which a medium to be deposited or from which a medium to be withdrawn and a second space into which medium when being rejected is dispensed;

wherein, when the medium is picked up from one of the plurality of spaces, a medium withdrawn or deposited is transferred through the first path and a rejected medium is transferred through the second path; and wherein the medium handling apparatus further comprises a first pick-up roller to pick up a medium from the first space and a second pick-up roller to pick up a rejected medium from the second space.

15. The financial device of claim 14, wherein the medium handling apparatus comprises a front guider, a first pressing part disposed at a rear side of the front guider, a second pressing part disposed at a rear side of the first pressing part, and a rear guider disposed at a rear side of the second pressing part;

wherein the first space of the plurality of divided spaces is defined between the front guider and the first pressing part;

wherein the second space of the plurality of divided spaces is defined between the second pressing part and the rear guide; and wherein a medium to be deposited is accepted in the first space, a medium to be withdrawn is dispensed into the first space, and a rejected medium is dispensed into the second space.

16. The financial device of claim 14, further comprising a mode change unit to change a medium handling mode of the medium handling apparatus, wherein the medium handling mode comprises a first mode and a second mode;

wherein a medium to be deposited is accepted in the first space, and a medium to be withdrawn is dispensed in the first space in the first mode; and wherein a medium to be deposited is accepted in the second space, and a medium to be withdrawn is dispensed in the second space in the second mode.

17. The financial device of claim 16, wherein the mode change unit comprises a sensor to detect a customer, and when the customer is detected by the sensor, the medium handling mode is changed from one mode of the first and second modes to the other mode of the first and second modes.

18. The financial device of claim 17, wherein, when the customer is detected by the sensor and a transaction is finished, the medium handling mode is changed from the other mode to the one mode.

19. The financial device of claim 16, wherein the mode change unit comprises a user interface to display a menu and information for depositing or withdrawing and to input or select a command or information for depositing or withdrawing.

20. The financial device of claim 16, wherein the first space is disposed at a front side of the second space, and the front side is a side that is proximate to a front surface of the financial device.

21. A financial device comprising:

a customer information acquisition part to acquire customer's information;

a medium handling apparatus to deposit or withdraw a medium; and a mode change unit to change a mode of the medium handling apparatus;

wherein the medium handling apparatus comprises a front guider, a first pressing part disposed at a rear side of the front guider, a second pressing part disposed at a rear side of the first pressing part, and a rear guider disposed at a rear side of the second pressing part; and wherein the medium to be deposited or withdrawn is accepted in or dispensed from, respectively, a space between the front guider and the first pressing part in a first mode and in a space between the second pressing part and the rear guider in a second mode;

wherein the medium withdrawn or deposited is transferred through a first path in the first mode, and wherein the medium withdrawn is transferred through the first path in a first direction, and the medium deposited is transferred through the first path in a second direction opposite to the first direction.

* * * * *